US006628273B1

(12) United States Patent
Rindal et al.

(10) Patent No.: US 6,628,273 B1
(45) **Date of Patent: *Sep. 30, 2003**

(54) METHOD AND APPARATUS FOR SELECTIVE ENABLING OF ADDRESSABLE DISPLAY ELEMENTS

(75) Inventors: Abraham Rindal, Fremont, CA (US); Michele Law, Mountain View, CA (US); Joseph Miseli, San Bruno, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 96 days.

This patent is subject to a terminal disclaimer.

(21) Appl. No.: 09/690,954

(22) Filed: Oct. 17, 2000

Related U.S. Application Data

(63) Continuation of application No. 09/108,070, filed on Jun. 30, 1998, now Pat. No. 6,157,375.

(51) Int. Cl.[7] ..... G09G 5/00; G09G 3/20
(52) U.S. Cl. ..... 345/208; 345/204; 345/55
(58) Field of Search ..... 345/55, 60–62, 345/74.1, 87, 98, 100, 95, 173, 204, 208

(56) References Cited

U.S. PATENT DOCUMENTS

| | | | | |
|---|---|---|---|---|
| 4,543,572 A | | 9/1985 | Tanaka et al. | 340/723 |
| 4,775,861 A | | 10/1988 | Saito | 340/784 |
| 5,436,635 A | | 7/1995 | Takahara et al. | 345/92 |
| 5,519,414 A | | 5/1996 | Gold et al. | 345/208 |
| 5,583,527 A | * | 12/1996 | Fujisaki et al. | 345/55 |
| 5,619,225 A | | 4/1997 | Hashimoto | 345/98 |
| 5,977,961 A | * | 11/1999 | Rindal | 345/208 |
| 6,157,375 A | * | 12/2000 | Rindal et al. | 345/208 |

FOREIGN PATENT DOCUMENTS

| | | |
|---|---|---|
| DE | 27 48 149 | 5/1979 |
| EP | 814 454 | 12/1997 |
| WO | 96/15519 | 5/1996 |

OTHER PUBLICATIONS

European Search Report, Application No. 99304752, mailed Oct. 20, 1999.

* cited by examiner

*Primary Examiner*—Bipin Shalwala
*Assistant Examiner*—Jeff Piziali
(74) *Attorney, Agent, or Firm*—Robert C. Kowert; Meyertons, Hood, Kivlin, Kowert & Goetzel, P.C.

(57) ABSTRACT

A method and apparatus for driving a plurality of addressable elements consist of driving and selectively enabling one or more addressable elements arranged as an M×N array using two drivers. A first and a second driver are used to drive first and second signals at slightly different frequencies on a first and a second display conductor. A plurality of pixels, coupled between the first and second display conductors, is addressed according to a pixel location in which the first signal is approximately in phase with the second signal. The pixel scan rate is proportional to the difference between the first and second signal frequencies. The first and second conductors may contain a plurality of delay elements and tap-off points. Conducting lines may be terminated by their characteristic impedance to prevent any reflection of the traveling signals. The periods of the first and second signals may be greater than or approximately equal to a propagation delay of between first and last tap-off points on the first and second conductors, respectively. The pulse width of the first and second signals may be less than or approximately equal to a propagation time of the first and second signal between adjacent tap-off points on the first and second display conductors, respectively. The matrix display pixels are selectively enabled by modulating an amplitude of the first signal and/or an amplitude of the second signal when the selected pixel location(s) is addressed so that the voltage differential between the first and second signals is sufficient to enable the addressed pixel.

24 Claims, 11 Drawing Sheets

METHOD AND APPARATUS FOR SELECTIVE ENABLING OF ADDRESSABLE DISPLAY ELEMENTS

This application is a Continuation of U.S. Ser. No. 09/108,070 filed Jun. 30, 1998, now U.S. Pat. No. 6,157,375.

FIELD OF THE INVENTION

This invention relates to addressing of pixels arranged in an array format for displaying applications, and more particularly to driving pixel address lines in a video display.

BACKGROUND OF THE INVENTION

Addressable components that can be arranged in rows and columns are commonly found in applications ranging, e.g., from memory to panel video display devices. A matrix display apparatus for displaying video signals commonly comprises a display panel having an array of addressable components arranged in row and column lines of pixels. The two-dimensional row and column lines are usually arranged in a rectangular format. The addressable component is called a picture element, display element, or pixel, and consists of a light sensitive element. The display element may emit, reflect, or transmit light in response to signals addressed into the line. Display elements may be made from different materials and may be constructed in various ways depending on the type and use of the display device. Various types, such as liquid crystal cells, electrochromic cells, plasma cells, fluorescent display tubes, light-emitting diodes (LEDs), and electroluminescence cells have been known. Light modulating materials used to construct display elements have been well known in the industry, and they fundamentally depend on an applied electric field to modulate the amount of light emitted, reflected, or transmitted. Some of the light modulating materials do not exhibit sharp electric field versus light excitation characteristics. Thus, an active device such as a diode or transistor may be used in conjunction with the addressable components to improve the pixel light characteristics. For example, the use of a thin film MOS field effect transistor (TFT) as a switching element is well known to the artisans in the field.

The light output of the picture element may be proportional to the applied addressing signal in the matrix display. In order to address a specific picture element, or pixel, in a matrix display, the pixel must be identified and excited. The excited pixel will emit, reflect, or transmit light accordingly. The pixel in the latter case is being enabled. Within an array of a pixel matrix, each pixel may have a unique address that is specified in terms of row and column location, e.g., the element at row x, and column y, or element (x,y). To excite the pixel (x,y), so that to set it to the "on" status, the pixel (x,y) is enabled by addressing the location (x,y) and exciting the pixel. The pixel may be excited by supplying a voltage above a threshold level to the addressed location.

In one addressing technique, the pixel (x,y) is electrically coupled to a row conductor which intersects with a column conductor. The pixel (x,y) is enabled by addressing the specific row conductor line x and the column conductor line y. Each line is addressed by a driving means, which addresses the line according to an applied signal. The driving means consists of a column driver circuit for each column operable according to the line frequency of an applied video signal for supplying data signals derived therefrom to the column in which the pixel is electrically coupled, a row driver circuit for each row for scanning the row in which the pixel is electrically coupled to, and a control circuit which controls the timing of operation of the driver circuits, which is responsive to an applied video signal.

All pixels arranged in a row line are electrically coupled to a row line and thus to a row driver. Pixels arranged in a column line are electrically coupled to a column line and thus to a column driver. Therefore, M pixels in one row are commonly coupled to a row driver, and each separately coupled to one of M column drivers. Similarly, N pixels in one column are commonly coupled to a column driver, and each separately coupled to one of N row drivers. A matrix display of M×N pixels usually requires M column drivers and N row drivers, or M+N line drivers. Thus, a display with a resolution of 1280×1024 pixels consists of 1,310,720 pixels, 1280 columns of pixels and 1024 rows of pixels, and 2304 line drivers. Images are formed by enabling, or disabling, selected pixels in the pixel array usually in sequential manner from left to right and top to bottom.

FIG. 1 depicts a conventional video matrix display device 100 comprising a plurality of pixels P that are arranged along the y-axis in N rows driven by drivers $R_N$ and along the x-axis in M columns driven by drivers $C_M$. Each pixel P has two connecting ports. The first port 122 of the pixel $P_{1,1}$, is coupled to the row line 110*a* and the second port 112 of the pixel is coupled to the column line 120*a*. The first port of pixels $P_{1,1}$ to $P_{1,M}$ are electrically coupled to row 110*a*, while the second ports are separately coupled to the corresponding columns driven by $C_1$ to $C_M$. For example, to enable pixel $P_{3,4}$ row line 110*c* is addressed through driver $R_3$, and column line 120*d* is simultaneously addressed through driver $C_4$. A specific pattern of pixels may be addressed for enabling the pixels by activating a plurality of row and column drivers in a sequential manner. Thus, a large number of drivers are physically needed to construct a matrix display. The number of drivers increases with the increase in the display resolution since larger numbers of rows and columns are needed. A need therefore exists to reduce the number of drivers in a device using addressable components. For high-resolution displays, the cost of a large number of drivers may be significant to the overall cost of the display. The complexity of circuitry components associated with the drivers, such as signal generators, control units, and driver memory also increases with resolution, and further provides a disadvantage in addition to the large number of drivers. Reducing the number of needed drivers in matrix display devices, such as flat panel displays, while achieving or maintaining the same or better image resolution is desirable.

SUMMARY OF THE INVENTION

The problems identified above are in large part solved by a matrix display method and apparatus that eliminates the large number of row and column line drivers needed to address and selectively enable addressable elements or pixels. To achieve the above advantage, an embodiment of the apparatus may provide a total of only two drivers to drive a M×N display device, such as a flat panel display. A first and a second driver may be used to drive first and second signals at slightly different frequencies (or phase) on a first and a second display conductor. A plurality of pixels may be coupled between the first and second display conductors. The pixels may be addressed according to a pixel location in which the first signal may be approximately in phase with the second signal. The pixel location changes from one pixel to the next at a scan rate proportional to the difference between the first and second signal frequencies. The first and second conductors may contain a plurality of delay elements and tap-off points, wherein each pixel may be coupled between tap-off points on the first and second conductors. A plurality of pixel row and column conductors may be provided, each connected to a different tap-off point of the first and second display conductors.

The row and column conductors may be terminated by their characteristic impedance to prevent any reflection of the traveling signal. Further, the first and the second display conductors may also be terminated by their characteristic impedance to prevent any reflection of the signals traveling on any of the conductors. The periods of the first and second signals may be greater than or approximately equal to a propagation delay of between first and last tap-off points on the first and second conductors, respectively. The pulse width of the first and second signals may be less than or approximately equal to a propagation time of the first and second signal between adjacent tap-off points on the first and second display conductors, respectively. The matrix display pixels may be selectively enabled by modulating an amplitude of the first signal and an amplitude of the second signal when the selected pixel location(s) is addressed so that the voltage differential between the first and second signals is sufficient to enable the addressed pixel.

Broadly speaking, the present invention comprises a method and apparatus to selectively enable addressable elements in a M×N array arrangement. The invention comprises two separate display conductors driven by two separate drivers where the frequency of their signals is different. A plurality of addressable elements may be connected to tap-off points on the two display conductors. A plurality of row and column conductors may be connected to the first and second display conductors. Each row or column conductor may be connected into a single point on the display conductor and may be terminated by its characteristic impedance. The signals traveling on each display conductor may be sequentially delayed by delay elements. The pixels may be sequentially addressed at a rate proportional to the difference in frequency between the first and second signals, and may be selectively enabled according to the difference in amplitude between the first and second signals.

The present invention further contemplates a pixel display comprising a sequence of pixels, each pixel coupled between a first display conductor and a separate second display conductor wherein a first driver and a second drivers drive a first signal and a second signal on the first and second display conductors, respectively. The pixels may be sequentially addressed at a rate proportional to the difference in frequency between the first and second signals, while they may be selectively activated according to the difference in amplitude between the first and second signals.

The present invention further contemplates a method for driving an addressable elements array comprising driving a first signal on a first addressing conductor at a first frequency, and driving a second signal on a second addressing conductor at a second frequency. The second addressing conductor is separate from the first addressing conductor, and the first and second frequencies may be slightly different. The addressable elements may be sequentially addressed according to an addressable element location where the first signal is approximately in phase with the second signal. The activation of select addressable elements may be achieved by modulating the amplitudes of the first and second signals during the time when a pixel selected to be turned on is addressed so that the amplitude differential of the first and second signals may be sufficient to activate the selected addressable element

BRIEF DESCRIPTION OF THE DRAWINGS

Other features and advantages of the invention will appear from the following description in which the preferred embodiments have been set forth details, in conjunction with the accompanying drawings, in which.

Figure 1:
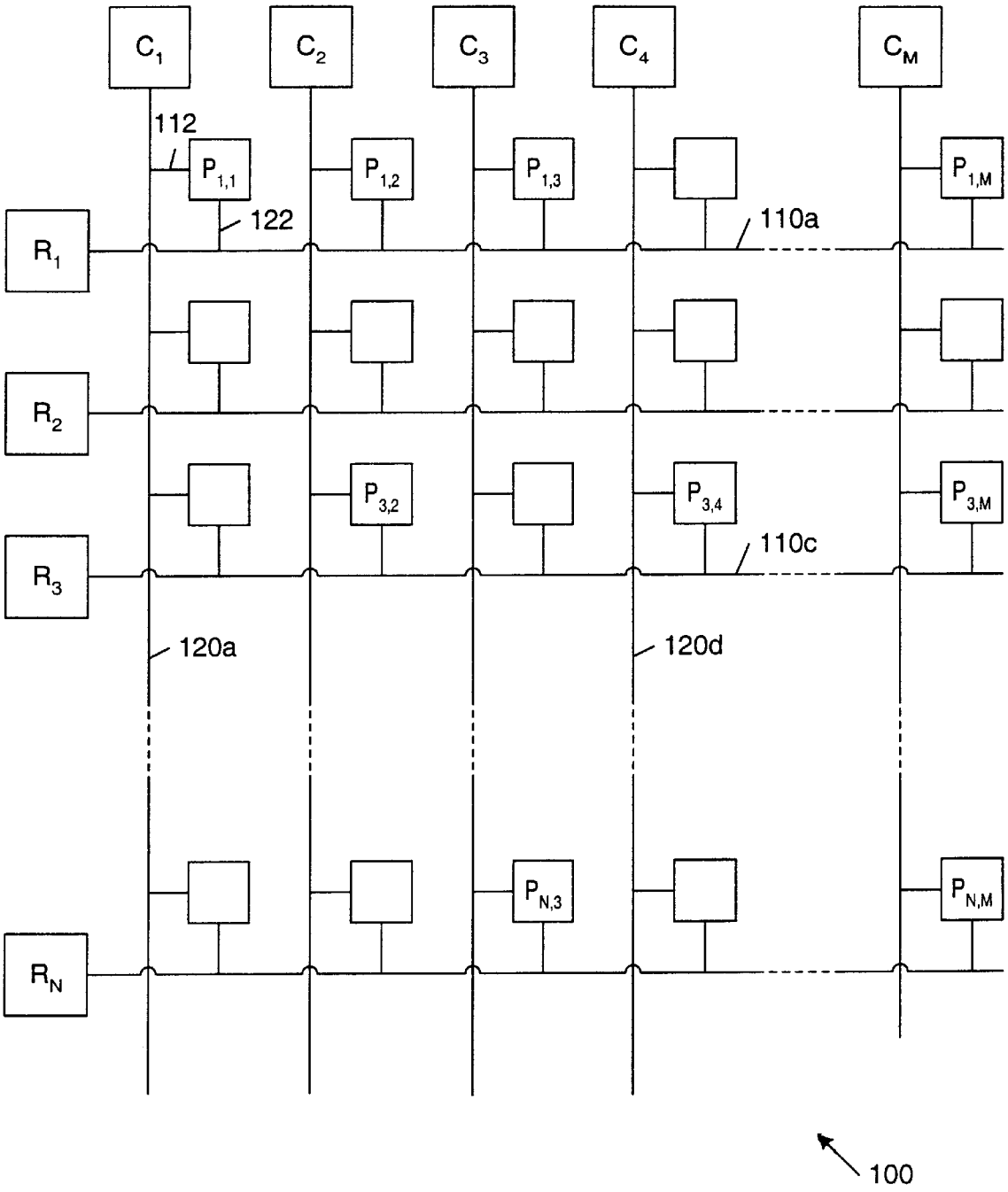
FIG. 1 (PRIOR ART)
FIG. 1 is a block diagram illustrating a matrix display device comprising M×N pixels, driven by a total of M+N drivers, according to the prior art.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Figure 2:
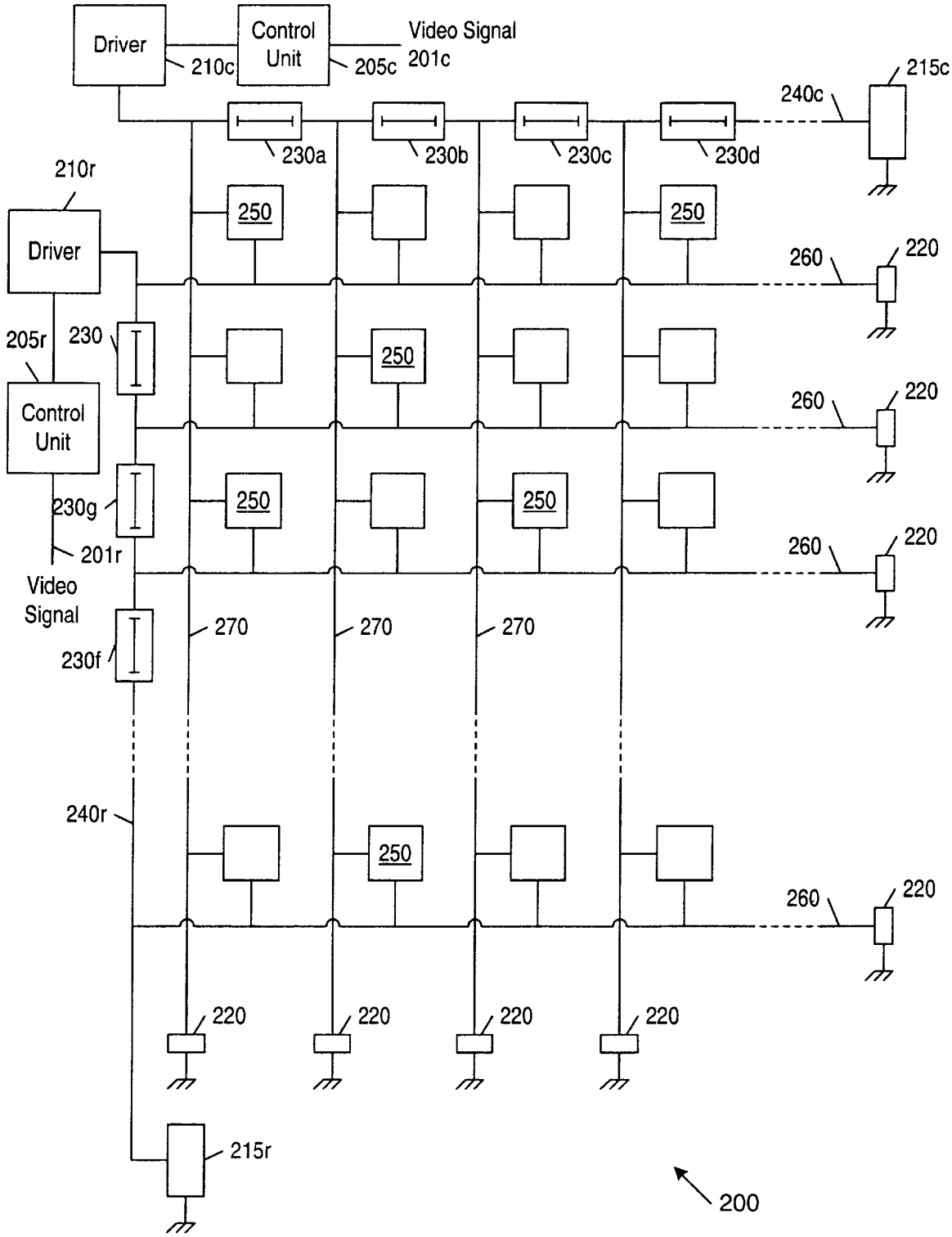
FIG. 2 is a block diagram illustrating an embodiment of a matrix display device comprising M×N pixels driven by two drivers.

Turning now to the drawings, FIG. 2 is a block diagram depicting an embodiment of a matrix display device 200 comprising M×N addressable elements, or pixels, 250 driven by two drivers 210*r*, 210*c*. Each driver 210 generates a signal regulated by the control unit 205. The driver 210 signal is fed into display conductors 240 terminated by characteristic impedance 215 to prevent the signal from being reflected. Note that elements associated with column driver 210*c* may be designated with a "c" suffix, such as column display conductor 240*c*, and elements associated with row driver 210*r* may be designated with an "r" suffix, such as row display conductor 240*r*. However, these elements may be generically referred to without the suffix. Display conductor 240 may be any signal conduction medium that permits propagation of the signal from the driver 210 to the impedance termination unit 215. The signal generated by driver 210 propagates through display conductor 240 at a speed proportional to the speed of light ($3\times10^8$ meter/sec), and inversely proportional to the square root of the dielectric constant of the conductor material. The signals generated by drivers 210 are different in frequency or in phase. Display conductor 240 may comprise delay elements 230, which delay the signal propagation between two adjacent columns or rows. The plurality of pixels 250 in the matrix display device 200 is shown arranged in a rectangular format comprising M electrically conductive lines 270 (columns) and N electrically conductive lines 260 (rows). It will be appreciated by those skilled in the art that arrangements of the plurality of pixels 250 are not restricted to only rectangular format but they can be made into different shapes and patterns. Columns 270 and rows 260 are electrically coupled separately to lines 240 so that the signals traveling in respective display conductors 240*c,r* may be propagated through the conductive columns and rows. Each of the plurality of columns 270 and each of the plurality of rows 260 may be terminated by an impedance element 220. Impedance element 220 is selected so that no reflection is allowed for the signal traveling down that line. Each of the plurality of pixels 250 is coupled to a conductive column 270 and a conductive row 260.

An individual pixel of plurality of pixels 250 is enabled, or disabled, based on the conditions of the signals being conducted through at least one column 270 and one row 260. The conditions comprise the frequency difference between the signals of the drivers. 210 and amplitude of at least one driver 210 signal. The frequency difference is determined based on driver 210 signal frequencies, the delay characteristics of the display conductor, and the type of the addressable elements. The amplitude of one or both signal drivers is determined based on modulating video signals. Only two drivers may be needed to address M×N pixels compared to M+N drivers needed to address the same number of elements in the prior art.

Figure 3:
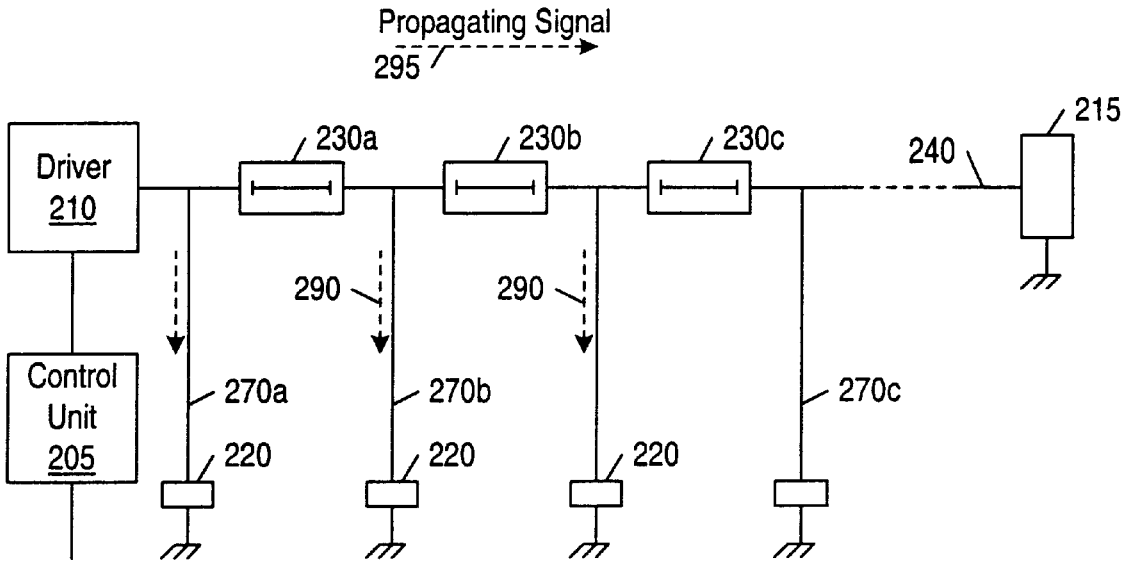
FIG. 3 depicts the propagation of signals within a matrix display.
Figure 4:
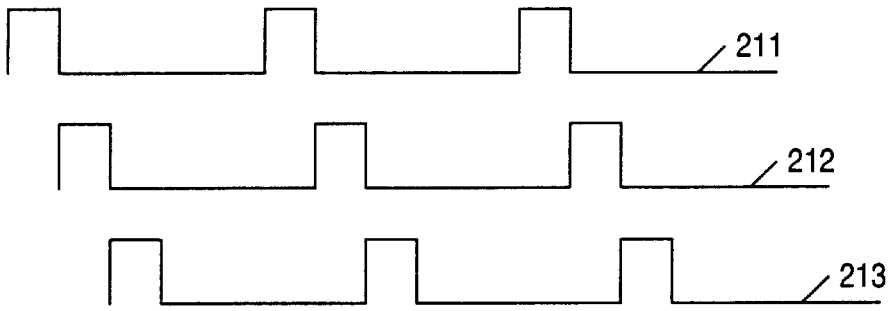
FIG. 4 illustrates signal waveforms associated with FIG. 3, in sequential manner at a point of time.

Turning now to FIGS. 3 and 4, the propagation of signals according to the embodiment of FIG. 2 is illustrated. FIG. 3 depicts a portion the matrix display device 200 showing control unit 205, signal driver 210, display conductor 240, delay elements 230, and impedance units 215 and 220. The direction of signal propagation down the line 240 is shown by the numeric 295. The directions of the signal propagation down the conductive columns 270 are shown by the numeric 290. FIG. 4 shows the waveform of a driving signal generated by signal driver 210 and transmitted through line 240. The specific wave shape is arbitrary, and the driver signal is shown as numeric 211. Signal 211 is fed into the delay element 230*a* before reaching column 270*b*. The signal 211 is the same at the first column 270*a* moving in the direction 290. The signal 212 is generated in column 270*b* due to the delay by 230*a*. Further, the signal 213 is generated in column 270*c* due to the delay by delay element 230*b*. Similarly, the signal propagated through line 240 is sequentially delayed m-1 times before reaching the last conductive column 270*m*.

Figure 5:
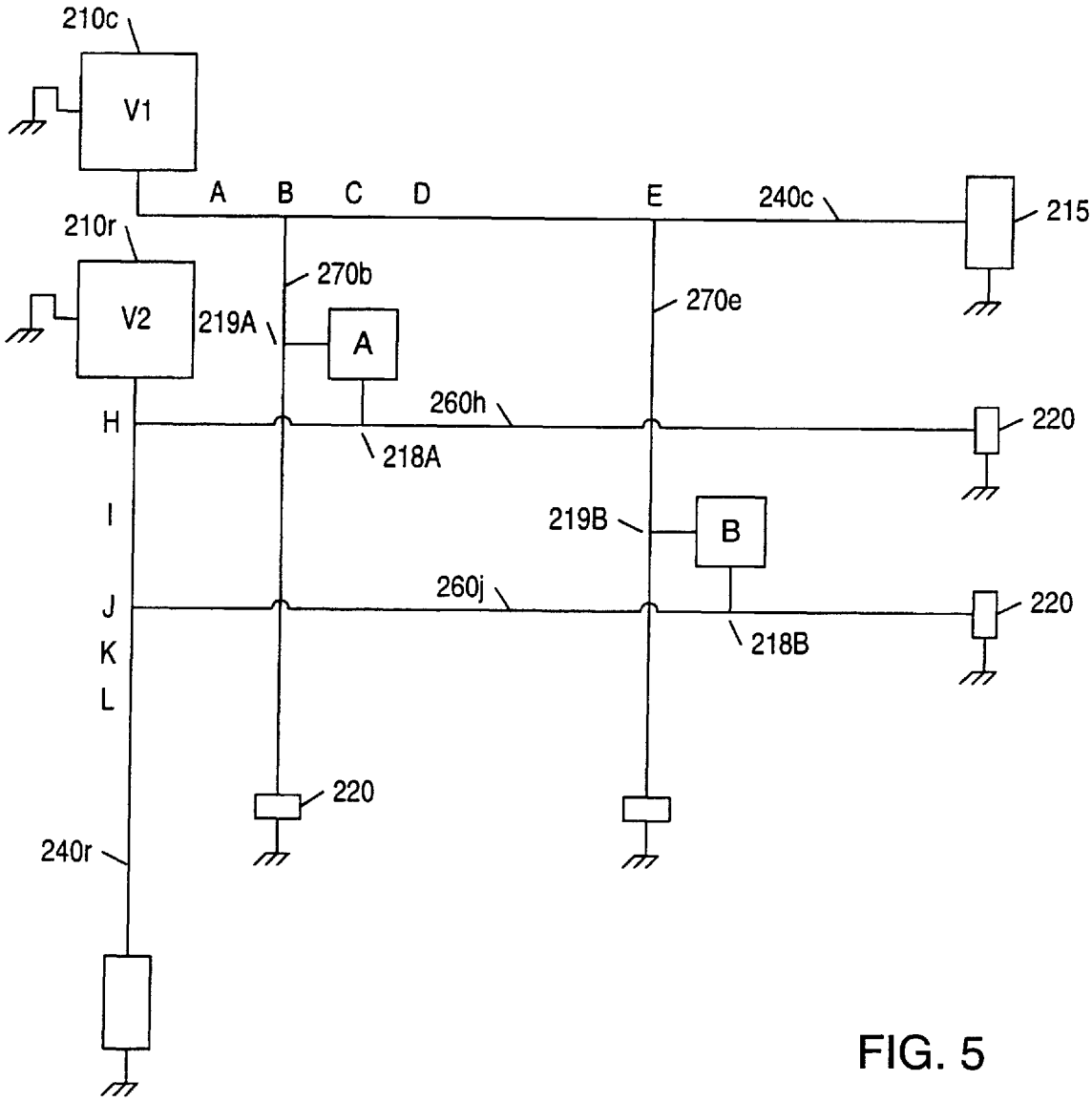
FIG. 5 is a simplified diagram to illustrate how individual elements are addressed in a matrix display device.

Turning now to FIG. 5, an illustration of the principle of operation according to one embodiment is shown. Drivers 210*c* and 210*r* separately drive two display conductors 240*c* and 240*r*, respectively. Conductive lines forming columns 270 and rows 260 are used to drive the coupled pixels A and B. Columns are electrically coupled to line 240*c* at the locations (A–E), while the rows are electrically coupled to line 240*r* at the locations (H–L). For simplicity, only two columns and two rows are shown. Pixels A and B are electrically coupled to columns 270*b* and 270*e*, as shown at 219A and 219B, and electrically coupled to rows 260*h* and 260*j*, as shown at 218A and 218B. V1 and V2 represent the signals from drivers 210*c* and 210*r*, respectively, whose differential amplitude may be sufficient to enable or disable a pixel. The pulse width of the signals generated by 210*c* and 210*r* is selected to be the propagation time between two adjacent nodes (such as A and B) on the conductor line. The period of the voltage signals may be comparable to or greater than the propagation time each signal takes to travel down the lines 240. Therefore, at any point in time each location (A–E) across line 240*c* will have a different phase of the driving signal. Similarly, each location (H–L) across line 240*r* will have different phase of the driving signal. At some locations the differential voltage amplitude may be higher than a threshold level needed to enable a pixel, and at other locations may be lower than the threshold level.

Since the periods of the voltage signals V1 and V2 may be set comparable to (or greater than) the signal propagation time the signals take to travel down the lines 240, the frequency of V1 and V2 may be proportional to the propagation delay of the lines 240. Since V1 and V2 have different frequencies, the amplitude of the differential voltage signal (the sum of V1 and V2) at any particular pixel location is the waveform where the shape of the high frequency carrier signal is the low frequency difference between the two signals. The rate of change of the differential voltage signal can be independently controlled by selecting the frequency difference between V1 and V2 signals. According to one embodiment, this control is provided by the control unit(s) 205 in FIG. 2 of this invention. The provided control function(s) is responsive to the video signal(s) 201 shown in FIG. 2. Since the amplitude of the differential voltage signal is the pixel addressing signal, which varies in both time and location, enabling or disabling of a specific pixel or a plurality of pixels may be achieved. Further, since the frequency of the modulated signal is much lower than the absolute frequency of V1 and V2 signals, addressing of pixels can be performed at a reasonably slow rate.

Considering now pixel A in FIG. 5. At a point of time when the signal V1 traveling line 240*c* at the location B has a specific amplitude that is considered "high", one port (or side) of pixel A will be set "high" through the coupling at 219A. To enable pixel A, the second signal V2 traveling down line 240*r* may be low at the row H at approximately the same point in time when the V1 signal is high at the column B, so that the other side of pixel A is set low through the coupling at 218A. If the amplitude of the differential voltage signal across pixel A has been modulated above the threshold level, pixel A will be enabled (turned on). Otherwise, pixel A is disabled (scanned, but turned-off).

Figure 6:
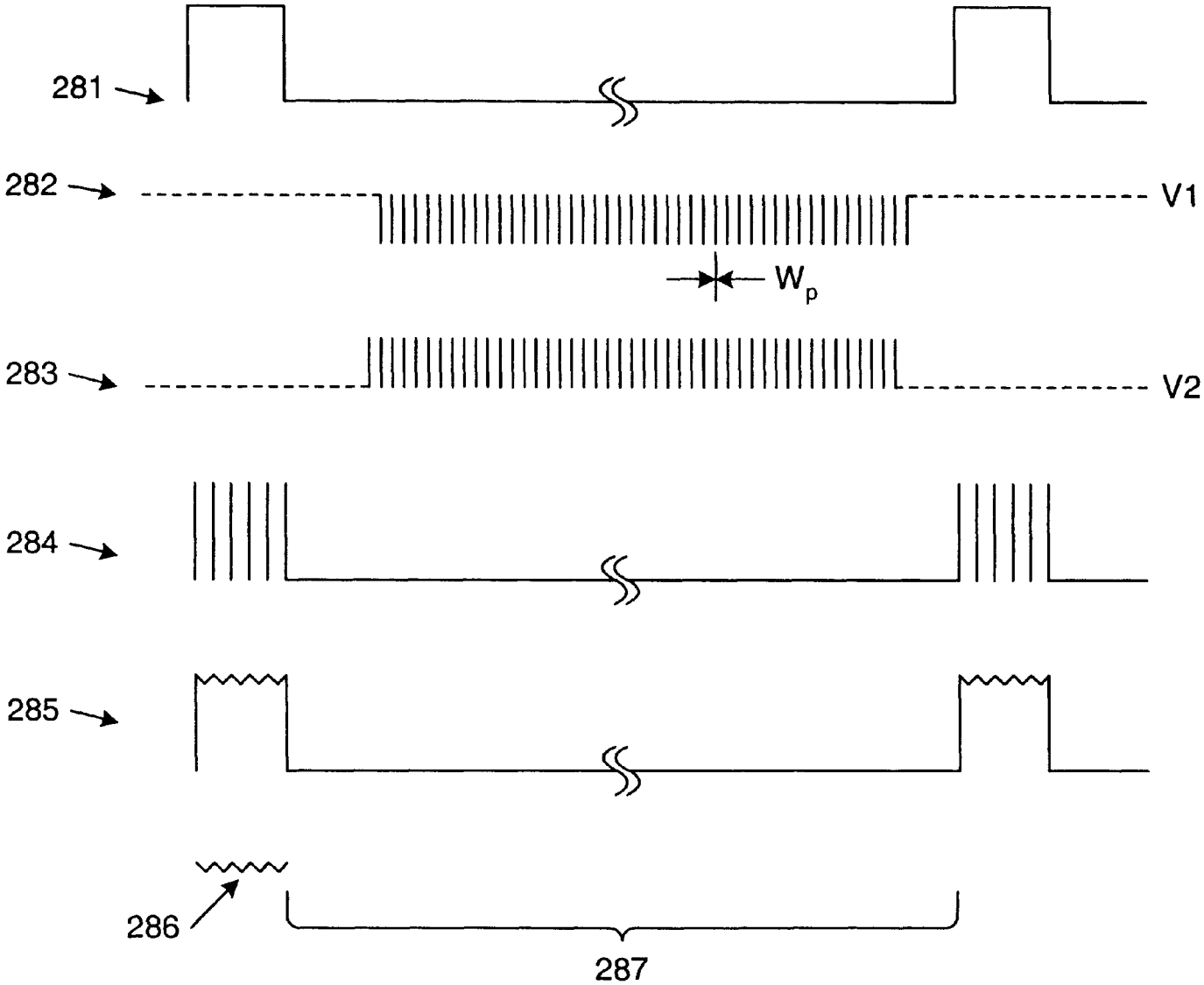
FIG. 6 illustrates display signal waveforms at various points of the display of FIG. 5.

FIG. 6 illustrates an example of the signals at various points of FIG. 5. The signal numeric 281 donates the desired voltage signal across the pixel A in order to enable pixel A. The desired voltage signal is applied across the nodes 219A and 218A. The numerics 282 and 283 refer to the driver signals V1 and V2, respectively. At the location shown, the signal 282 is the signal at node 219A and 283 is at node 218A. The numeric 284 shows the differential voltage signal (V2–V1) across pixel A. The actual signal across the pixel may be more of the shape of the signal 285 due to capacitance of the pixel. V1 may comprise periodic low-going pulses while V2 may comprise periodic high-going pulses. The pulse width is shown as $W_p$. During the point in time in which V1 and V2 are approximately in phase at the location of pixel A, the pulses of V1 will sum with the pulses of V2 to create the addressing/enabling differential voltage shown at time interval 286. If the amplitude of the signal pulses is modulated sufficiently high (low) during time interval 286, pixel A will be enabled (turned on). When V1 and V2 are not in phase at pixel A, as shown at time interval 287, pixel A is not addressed. The other pixel locations of the display are sequentially addressed during 287.

The pixel-addressing scheme above is given as a matter of example. Addressing of a pixel in accordance with this invention is not restricted to the example above. It will appreciated by those skilled in the art that the enabling, or disabling, of pixels can be achieved by various combination of the signal across nodes 218 and 219 that are appropriate to the particular addressable element. Possible combinations, in addition to the above example, include different signal shapes, orientation, duration, frequency, levels, and logic.

Figure 7:
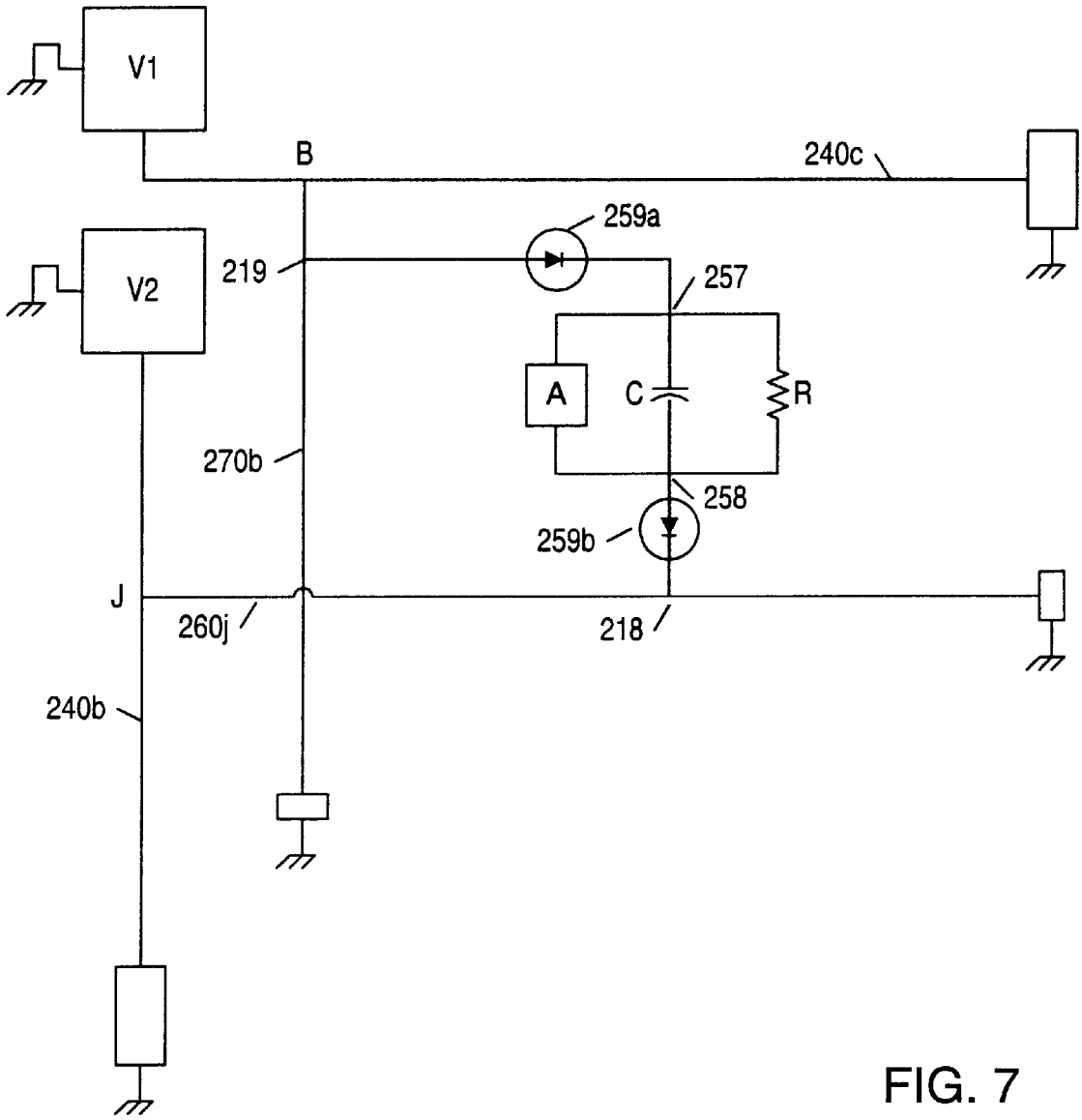
FIG. 7 illustrates the enabling of an addressable element that requires different enabling needs than those directly provided by the addressing signals.

As mentioned earlier, the signal generated by the driver 210 propagates in line 240 at a speed proportional to the speed of light and inversely proportional to the square root of the medium dielectric constant. The value of the dielectric constant is typically ranged between 1–10 for the majority of materials used in the field of electronics. Therefore, the driver signal travels the conductor line at a speed in the order of a few $10^8$ meters per second. For typical dimensions in a matrix display device such as video monitors, the distance between pixels is in the order of one millimeter or less ($10^{-3}$ meters), and the length of the display is in the order of tens of centimeters ($10^{-2}$ meters). The residence time the signal may spend on each coupling nodes on line 240, such as A–E and H–L of FIG. 5, can be assessed by:

$$Tr=(D)^{0.5}\times L/3\times 10^8\times N \text{ (seconds)}$$

where D is the conductor medium dielectric constant, L is the length of the conductor in meters, and N is the number of coupling nodes on the conductor. For a conductor line of 12 inches, and 1280 coupling nodes, the signal residence time on each node is in the order of few picoseconds. Depending on the practical addressable element technology, the residence time of enabling signals may be significantly greater than few picoseconds. In a typical addressable element, the residence time requirements of the enabling signal may be in the order of tens of nanoseconds. The total energy delivered to the addressable element may not be sufficient to enable the pixel if the applied pulse is very short. In such cases, a storage element is required to accumulate enough energy for sustaining the display element. Further, depending on the particular type of the display element, the signal across the element, or at the contact mode(s) may also need to be rectified or reshaped for the purpose of enabling the element. FIG. 7 shows an example which implements a storage element to enable a pixel when the addressing pulse width is much shorter than the element enabling need. The figure shows two diodes 259 coupled to address lines 270*b* and 260*j*, and a resistor and capacitor coupled across pixel A. When the signal at node 219 is high and the signal at node 218 is low, diodes 259 are conducting. The voltage at node 257 is the voltage of the line 240*c* less the voltage drop on diode 259*a*. The voltage at node 258 is the voltage of the line 240*r* plus the voltage drop across diode 259*b*. The voltage difference between nodes 257 and 258 is the addressing or enabling voltage pulse across the pixel A. This pulse occurs at a frequency proportional to the difference between drivers 210*c* and 210*r* signal frequencies, and applied across pixel A depending on the alignment of the high and low of the signals V1 and V2 at points B and G, respectively. The capacitor C coupled across the pixel A is selected to hold charge that is sufficient to sustain pixel A in the enabling state until the next enabling pulse, but not sufficient to enable pixel A by itself. Thus, the capacitor charge is discharged into resistor R if the next enabling pulse is not applied and consequently pixel A is disabled. The above example is intended only for the purpose of explanation and not to limit the invention to the specific application explained. It will be appreciated by those skilled in the art that numerous circuit combinations are possible to relate the addressing signal conditions into the specific enabling/disabling needs of the particular display element.

Figure 8:
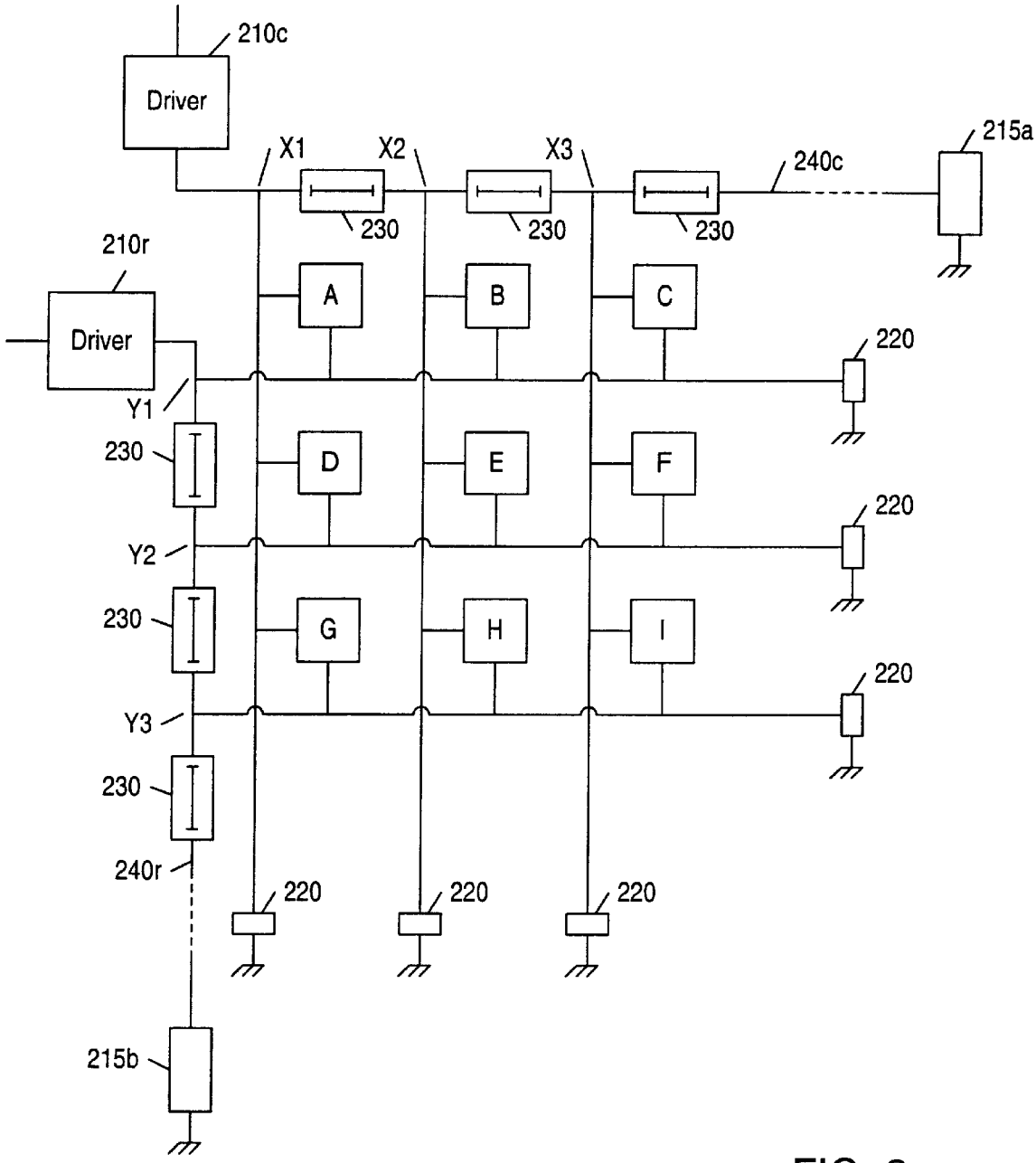
FIG. 8 depicts a plurality of pixels in a simplified matrix display device to illustrate the scanning of pixels.
Figure 9:
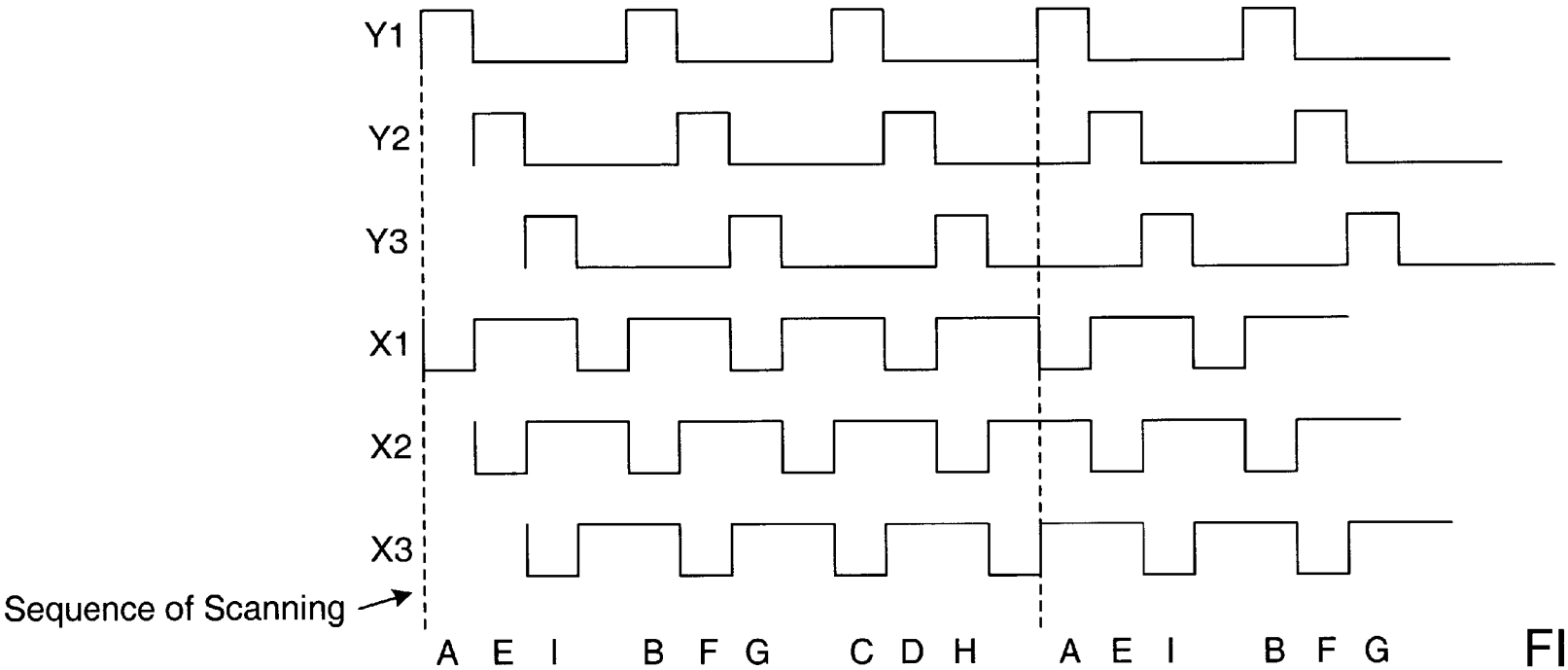
FIG. 9 illustrates the wave fronts of signals in FIG. 7 illustrating the scanning (e.g., sequential addressing) of a plurality of pixels.
Figure 10:
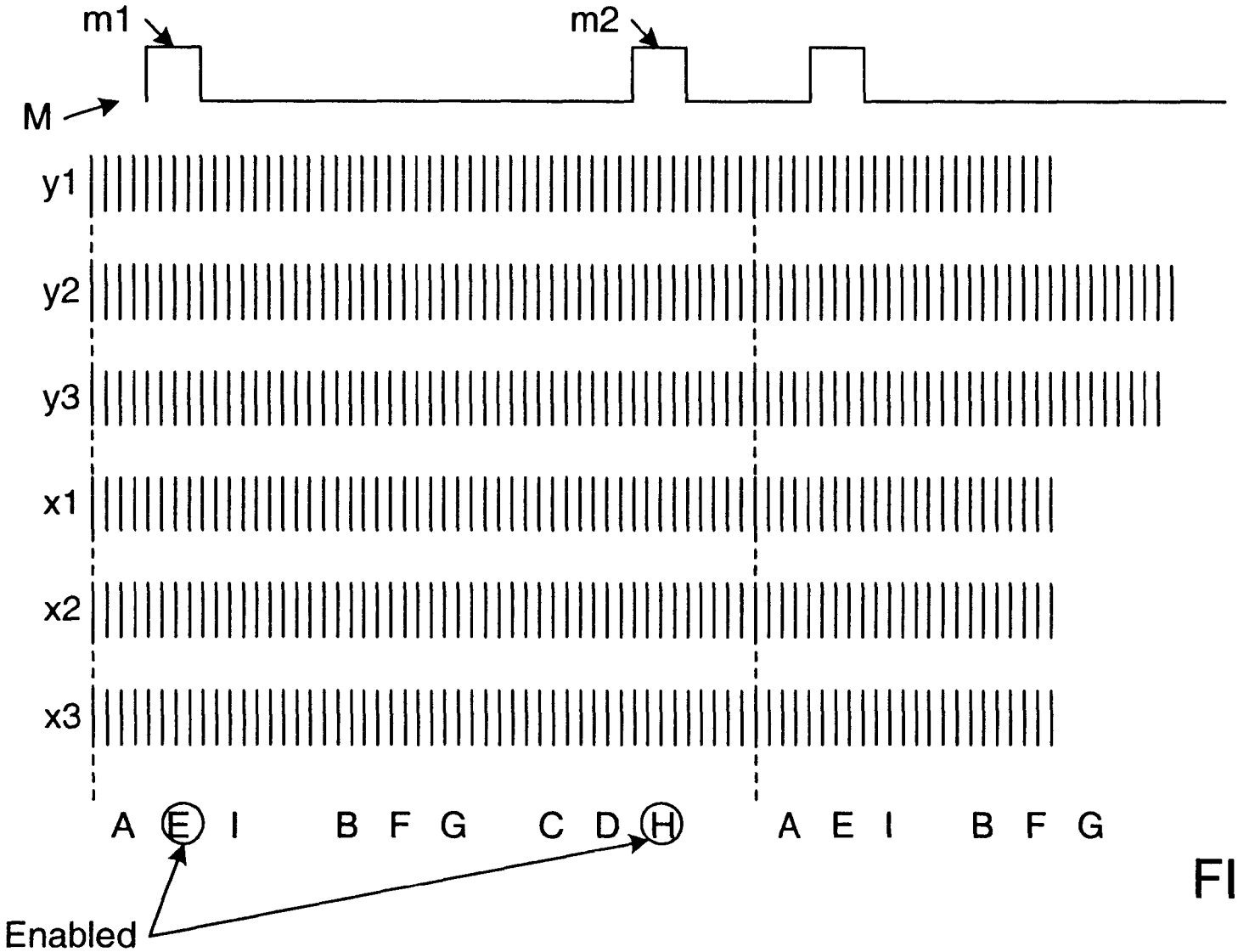
FIG. 10 illustrates the waveforms of driver signals and a modulating signal to enable a particular pixel in FIG. 7.

Turning now to FIGS. 8, 9 and 10, as an illustrative example, the scanning of a plurality of addressable elements (pixels) according to one embodiment of the present invention is shown. One port of each of a plurality of pixels (A, B, and C) are commonly coupled to row line yl while the other ports are coupled into column lines x1, x2, and x3, respectively. Similarly, pixels (D, E, F) and (G, H, I) are coupled into the corresponding row and address lines. The signal at y1, y2, and y3 is the time-dependent voltage of line 240*r*, generated by driver 210*r*, consequently delayed by delay elements 230. Similarly, the signal at x1, x2, and x3 is the time-dependent voltage of line 240*c*, generated by driver 210*c*, consequently delayed by delay elements 230. FIG. 9 shows an example of the signal waveform on line y1, y2, y3; and x1, x2, and x3. In this example, for simplicity of illustration, the driver 210*r* (FIG. 8) signal is selected as 180-degrees in phase compared to the driver 210*c* signal. Only nine pixels are shown for simplicity. Further, in this example, the enabling scheme is selected to occur if the voltage at the row addressing line is high and the voltage at the column addressing line is low. Consequently, if the voltage across the pixel is maximum (the difference between the two addressing signals), the pixel will be enabled. Otherwise the pixel will be disabled. As can be seen in FIG. 8, pixel A achieves simultaneous high and low signals, followed by pixel E, followed by pixel I, and so on. Since the addressing signals on lines 240 are delayed by a fixed amount by delay elements 230 between the row lines and the column lines; and the enabling pulse width is set equal to approximately the delay amount between two adjacent rows or columns to prevent more than one pixel being enabled at a time; a diagonal scanning results throughout the pixels. In this example, pixels A–I are diagonally scanned in the following sequence: A, E, I, B, F, G, C, D, H.

To enable (turn-on) a particular pixel or a plurality of pixels, the amplitude of the differential signal across the pixel is modulated by the incoming video signal. FIG. 10 shows the signals at row y1, y2, and y3; and column x1, x2, and x3, along with a modulating signal M. Note that pulse train signals are shown wherein multiple pulses will sum across a given pixel to address/enable the pixel, as opposed to the single pulse example of FIG. 9. The position of the letters A, E, I, B, F, etc, indicate the time during which the pulse train signals on row y1, y2, y3 and column x1, x2, x3 are in phase at the corresponding pixel location. To enable pixel E and H, for example, the amplitude of at least one driver signal is modulated. The modulation occurs at the time when the scanning effect reaches the particular pixels to be enabled, i.e., when the signals are approximately in phase at that pixel location. FIG. 10 shows the time-dependent modulating signal M with two pulses m1 and m2, where the time delay between m1 and m2 correspond to the scanning delay between pixel E and pixel H. The pulse m1 occurs at the time when the pixel scanning is addressing pixel E, thus pixel E is enabled. Similarly, the pulse m2 occurs at the time when the pixel scanning is addressing pixel H, thus pixel H is enabled. If the drivers' signal frequencies are much higher than the enabling need of the particular display element, many driver pulses may coincide across the pixel before the addressing location moves into the next pixel. Thus, allowing for the simple video modulation described above. The time between the two vertical dashed lines is the time required for one complete scan of the nine pixel display. In the first scan illustrated in FIG. 10, only pixels E and H are enabled (turned on). It is clear how this nine pixel example may be expanded to any desired display size or resolution.

Figure 11:
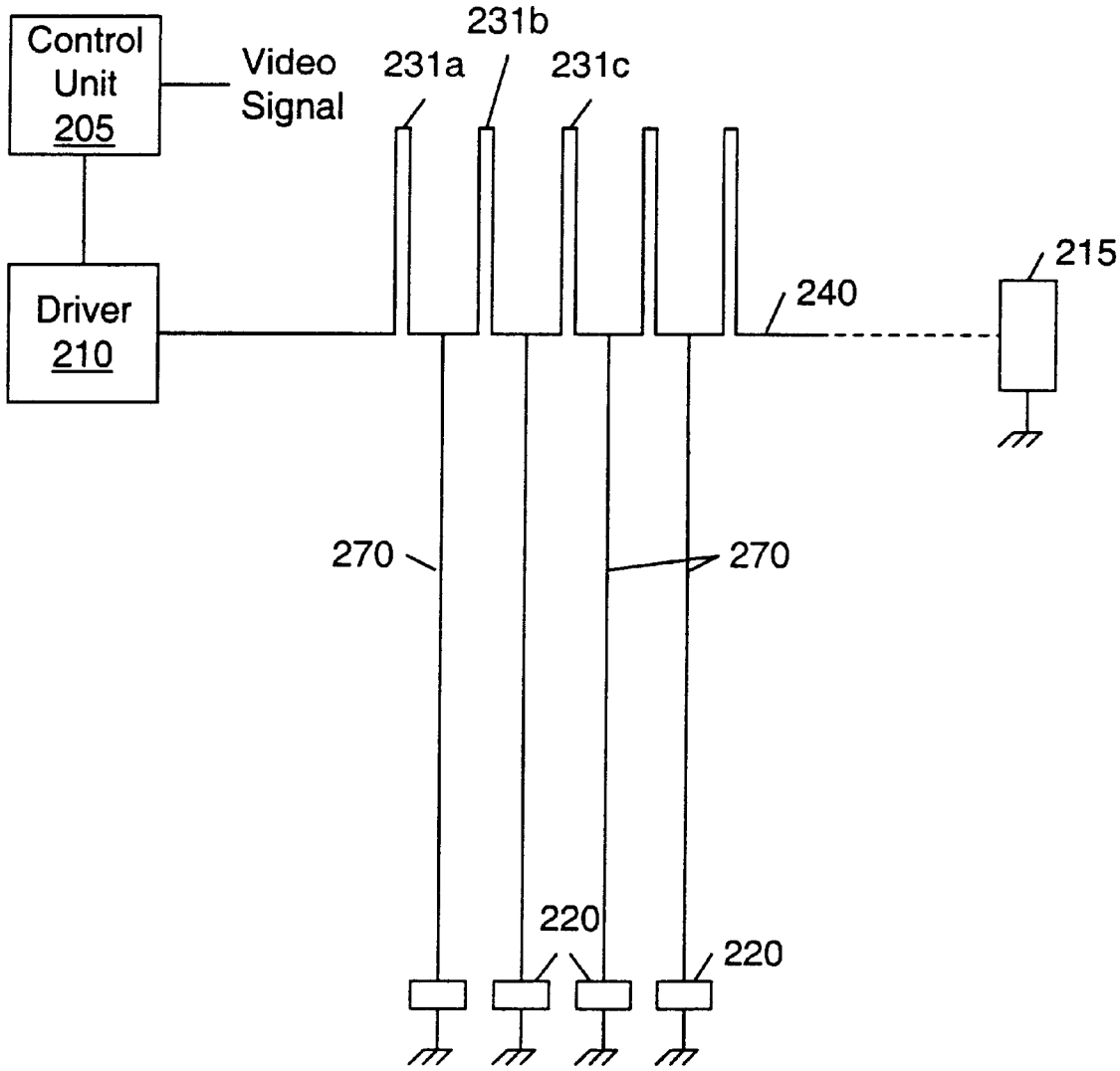
FIG. 11 depicts an embodiment in which the delay elements of FIG. 3 are extensions made on a circuit board.
Figure 12:
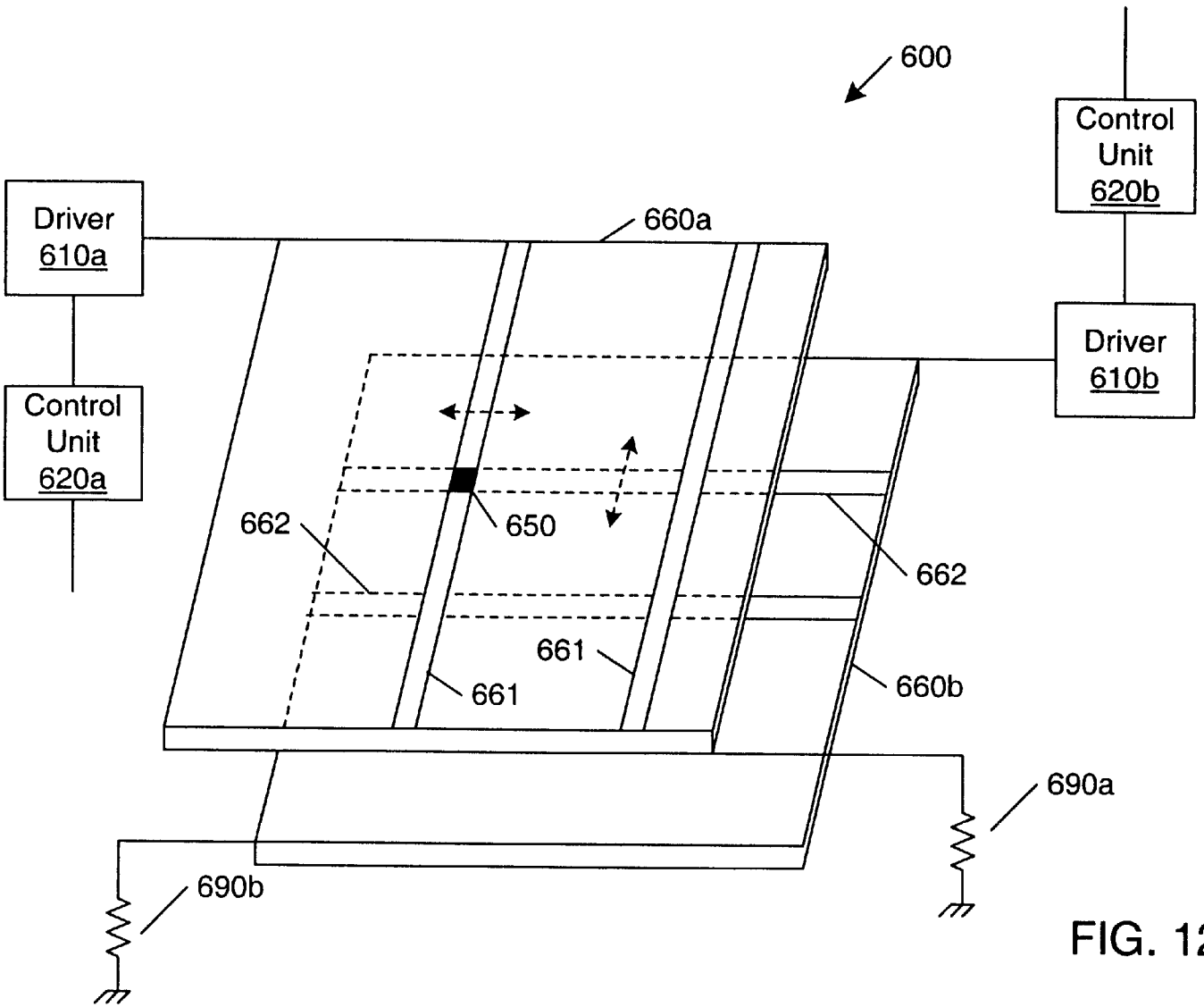
FIG. 12 depicts an embodiment in which the display conductor is a plane.

The elements of the display device according to the present invention are not restricted to the specific examples given in the figures. For example, the delay elements, display conductors, address lines, as well as the addressable elements may be implemented using different techniques known in the art. By a means of example, FIG. 11 depicts an embodiment in which the delay elements are made as extensions of the first and second conductors. For example, a delay element may comprise a serpentine printed circuit board trace. Numeric 231 represent delay elements as taps made of the conductor line 240. The addressing lines 270 are coupled to line 240 between the delay elements. FIG. 12 depicts a display 600 comprising a first plane 660*a* and a second plane 660*b* acting as a first and second displays conductors. Plane 660*a* is coupled into driver 610*a*, which drives the addressing signal through 660*a*. Plane 660*b* is coupled into driver 610*b*, which drives the addressing signal through 660*b*. Drivers 610 are coupled to control units 620 which control the addressing signals in accordance with the video signals to be displayed. Conducting planes 660 are coupled to units 690 to prevent any wave reflection that may occur in the conducting planes. In this embodiment, portions of the plane conductor 610*a* act as column addressing bands 661, while portions of the plane conductor 660*b* act as row addressing bands 662. An addressable element or pixel 650 is created in the area where enabled bands of the two conducting planes overlap. A particular pixel or a plurality of pixels is addressed when the signals through the addressing bands 661 and 662 meet designated requirements needed to enable the addressable element.

The preferred embodiments have been described with respect to addressing a plurality of pixels arrayed in M rows and N columns in a display. The present invention may be used with other devices that relay or use addressable arrays, including imaging devices such as CCD video cameras, printers, touch screens, etc. Further, the present invention may be used to address any M×N addressable elements that require or implement selectability functions for the purpose of pointing, saving, loading, storing, retrieving, arranging, and displaying. It will be appreciated by those skilled in the art having the benefit of this disclosure that the forms and elements of the invention shown and described are to be taken as exemplary, presently preferred embodiments. Various modifications and changes may be made without departing from the spirit and scope of the invention as set forth in the claims. It is intended that the following claims be interpreted to embrace all such modifications and changes.

What claimed is:

1. A display apparatus, comprising:

a first display conductor;

a second display conductor separate from said first display conductor;

a plurality of display elements, wherein each one of said plurality of display elements is coupled between said first display conductor and said second display conductor;

a first driver configured to drive a first signal on said first display conductor and to each of the plurality of display elements wherein said first driver is configured to drive said first signal from only one end of said first display conductor; and a second driver configured to drive a second signal on said second display conductor and to each of the plurality of display elements, wherein said second driver is configured to drive said second signal from only one end of said second display conductor;

wherein each one of said plurality of display elements is configured to be addressed when said first signal and said second signal have an addressing phase relationship at that display element and a different non-addressing phase relationship at the other ones of the plurality of display elements.

2. The display apparatus as recited in claim 1, wherein a time when said addressing phase relationship exists at each different one of the display elements is dependent upon a frequency difference between said first signal and said second signal.

3. The display apparatus as recited in claim 1, wherein each one of said plurality of display elements is configured to be activated when it is addressed and when a voltage difference between said first signal and said second signal is above a threshold.

4. The display apparatus as recited in claim 1, wherein said display elements are configured as an array comprising a plurality of columns and a plurality of rows, wherein said plurality of columns are coupled to said first display conductor and said plurality of rows are coupled to said second display conductor.

5. The display apparatus as recited in claim 4, wherein said first display conductor comprises a delay element between each said column, and wherein said second display conductor comprises a delay element between each said row.

6. The display apparatus as recited in claim 5, wherein a pulse width of said first signal is less than or approximately equal to a propagation time of said first signal between adjacent columns, and wherein a pulse width of said second signal is less than or approximately equal to a propagation time of said second signal between adjacent rows.

7. The display apparatus as recited in claim 5, wherein a period of said first signal is greater than or approximately equal to a propagation delay of said first signal from a first one of said columns to a last one of said columns, and wherein a period of said second signal is greater than or approximately equal to a propagation delay of said second signal from a first one of said rows to a last one of said rows.

8. The display apparatus as recited in claim 4, wherein said display elements are configured to be sequentially addressed along diagonals of said matrix.

9. The display apparatus as recited in claim further comprising:

a first signal terminator on said first display conductor configured to inhibit said first signal from reflecting on said first display conductor; and a second signal terminator on said second display conductor configured to inhibit said second signal from reflecting on said second display conductor.

10. The display apparatus as recited in claim 1, further comprising a capacitor and rectifying circuit coupled across each display element.

11. A display apparatus, comprising:

a first display conductor;

a second display conductor separate from said first display conductor;

a plurality of display elements, wherein each one of said plurality of display elements is coupled between said first display conductor and said second display conductor;

a first driver configured to drive a first signal on said first display conductor; and a second driver configured to drive a second signal on said second display conductor;

wherein said plurality of display elements are configured as an array comprising a plurality of columns and a plurality of rows, wherein said plurality of columns are coupled to said first display conductor and said plurality of rows are coupled to said second display conductor, wherein said first display conductor comprises a delay element between each said column, and wherein said second display conductor comprises a delay element between each said row;

wherein a pulse width of said first signal is less than or approximately equal to a propagation time of said first signal between adjacent columns as effected by each delay element, and wherein a pulse width of said second signal is less than or approximately equal to a propagation time of said second signal between adjacent rows as effected by each delay element; and wherein each one of said plurality of display elements is configured to be addressed according to a phase relationship between said first signal and said second signal.

12. The display apparatus as recited in claim 11, wherein said phase relationship is dependent upon a frequency difference between said first signal and said second signal.

13. The display apparatus as recited in claim 11, wherein each one of said plurality of display elements is configured to be activated when it is addressed and when a voltage difference between said first signal and said second signal is above a threshold.

14. The display apparatus as recited in claim 11, wherein a period of said first signal is greater than or approximately equal to a propagation delay of said first signal from a first one of said columns to a last one of said columns, and wherein a period of said second signal is greater than or approximately equal to a propagation delay of said second signal from a first one of said rows to a last one of said rows.

15. The display apparatus as recited in claim 11, wherein said display elements are configured to be sequentially addressed along diagonals of said matrix.

16. The display apparatus as recited in claim 11, further comprising:

a first signal terminator on said first display conductor configured to inhibit said first signal from reflecting on said first display conductor; and a second signal terminator on said second display conductor configured to inhibit said second signal from reflecting on said second display conductor.

17. The display apparatus as recited in claim 11, further comprising a capacitor and rectifying circuit coupled across each display element.

18. A display apparatus, comprising:

a first display conductor;

a second display conductor separate from said first display conductor;

a plurality of display elements, wherein each one of said plurality of display elements is coupled between said first display conductor and said second display conductor;

a first driver configured to drive a first signal on said first display conductor; and a second driver configured to drive a second signal on said second display conductor;

wherein said plurality of display elements are configured as an array comprising a plurality of columns and a plurality of rows, wherein said plurality of columns are coupled to said first display conductor and said plurality of rows are coupled to said second display conductor, wherein said first display conductor comprises a delay element between each said column, and wherein said second display conductor comprises a delay element between each said row;

wherein a period of said first signal is greater than or approximately equal to a propagation delay of said first signal from a first one of said columns to a last one of said columns, and wherein a period of said second signal is greater than or approximately equal to a propagation delay of said second signal from a first one of said rows to a last one of said rows; and wherein each one of said plurality of display elements is configured to be addressed according to a phase relationship between said first signal and said second signal.

19. The display apparatus as recited in claim 18, wherein said phase relationship is dependent upon a frequency difference between said first signal and said second signal.

20. The display apparatus as recited in claim 18, wherein each one of said plurality of display elements is configured to be activated when it is addressed and when a voltage difference between said first signal and said second signal is above a threshold.

21. The display apparatus as recited in claim 18, wherein a pulse width of said first signal is less than or approximately equal to a propagation time of said first signal between adjacent columns, and wherein a pulse width of said second signal is less than or approximately equal to a propagation time of said second signal between adjacent rows.

22. The display apparatus as recited in claim 18, wherein said display elements are configured to be sequentially addressed along diagonals of said matrix.

23. The display apparatus as recited in claim 18, further comprising:

a first signal terminator on said first display conductor configured to inhibit said first signal from reflecting on said first display conductor; and a second signal terminator on said second display conductor configured to inhibit said second signal from reflecting on said second display conductor.

24. The display apparatus as recited in claim 18, further comprising a capacitor and rectifying circuit coupled across each display element.

* * * * *

UNITED STATES PATENT AND TRADEMARK OFFICE

CERTIFICATE OF CORRECTION

PATENT NO. : 6,628,273 B1
APPLICATION NO. : 09/690954
DATED : September 20, 2003
INVENTOR(S) : Rindal et al.

It is certified that error appears in the above-identified patent and that said Letters Patent is hereby corrected as shown below:

In the Claims:

Claim 9, line 46 between "claim" and "further", insert --1--.

Signed and Sealed this

Twenty-seventh Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 6,628,273 B1
APPLICATION NO. : 09/690954
DATED : September 30, 2003
INVENTOR(S) : Rindal et al.

It is certified that error appears in the above-identified patent and that said Letters Patent is hereby corrected as shown below:

In the Claims:

Claim 9, line 46 between "claim" and "further", insert --1--.

Signed and Sealed this

Tenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 6,628,273 B1
APPLICATION NO. : 09/690954
DATED : May 27, 2003
INVENTOR(S) : Rindal et al.

It is certified that error appears in the above-identified patent and that said Letters Patent is hereby corrected as shown below:

In the Claims:

Claim 9, line 46 between "claim" and "further", insert --1--.

This certificate supersedes the Certificate of Correction issued May 27, 2008.

Signed and Sealed this

Twenty-second Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 6,628,273 B1
APPLICATION NO. : 09/690954
DATED : September 30, 2003
INVENTOR(S) : Rindal et al.

It is certified that error appears in the above-identified patent and that said Letters Patent is hereby corrected as shown below:

In the Claims:

Column 10, Claim 9, line 46 between "claim" and "further", insert --1--.

This certificate supersedes the Certificate of Correction issued June 10, 2008 and July 22, 2008.

Signed and Sealed this

Twelfth Day of August, 2008

JON W. DUDAS
*Director of the United States Patent and Trademark Office*